US005152001A

United States Patent [19]

Hanamoto

[11] Patent Number: 5,152,001

[45] Date of Patent: Sep. 29, 1992

[54] COPYING APPARATUS THAT AUTOMATICALLY SETS MANUALLY INPUTTED CONDITIONS OF IMMEDIATELY PRECEDING INTERRUPT AS INITIAL COPY CONDITION FOR PRESENT INTERRUPT

[75] Inventor: Hiroyuki Hanamoto, Toyokawa, Japan

[73] Assignee: Minolta Camera Kabushiki Kaisha, Osaka, Japan

[21] Appl. No.: 542,643

[22] Filed: Jun. 25, 1990

Related U.S. Application Data

[63] Continuation of Ser. No. 110,412, Oct. 20, 1987, abandoned.

[30] Foreign Application Priority Data

Oct. 21, 1986 [JP] Japan ..... 61-251093

[51] Int. Cl.[5] ..... G06F 13/24; G03G 15/00

[52] U.S. Cl. ..... 395/800; 395/375; 364/DIG. 2; 364/928; 364/941; 355/314

[58] Field of Search ..... 355/208, 314, 311; 395/800, 375; 364/200 MS File, 900 MS File

[56] References Cited

U.S. PATENT DOCUMENTS

| | | | |
|---|---|---|---|
| 3,909,128 | 9/1975 | Sohm | 355/208 |
| 4,099,860 | 7/1978 | Connin | 355/14 X |
| 4,107,779 | 8/1978 | Fisk et al. | 364/518 |
| 4,275,958 | 6/1981 | Tachika et al. | 355/14 R |
| 4,543,643 | 9/1985 | Shibazaki et al. | 364/900 |
| 4,579,443 | 4/1986 | Abuyama et al. | 355/314 |
| 4,678,316 | 7/1987 | Abuyama | 355/314 |
| 4,711,556 | 12/1987 | Abuyama | 355/314 |
| 4,835,572 | 5/1989 | Ide | 355/243 |

*Primary Examiner*—Thomas C. Lee
*Assistant Examiner*—L. Donaghue
*Attorney, Agent, or Firm*—Burns, Doane, Swecker & Mathis

[57] ABSTRACT

A copying apparatus having an interrupt copying function is disclosed which comprises a memory for storing copying conditions, an input device for inputting copying conditions, a copying control for performing copying operations according to stored copying conditions, a memory for storing interrupt copying conditions, a mode selection devices for selecting the interrupt mode, and a system for making, when the interrupt copying mode is selected, initial setting of copying conditions for the interrupt copying operation by setting up copying conditions that are stored in the memory for interrupt copying conditions in the aforementioned memory for copying conditions, whereby the operation for storing copying conditions is simplifed or can be eliminated.

5 Claims, 4 Drawing Sheets

COPYING APPARATUS THAT AUTOMATICALLY SETS MANUALLY INPUTTED CONDITIONS OF IMMEDIATELY PRECEDING INTERRUPT AS INITIAL COPY CONDITION FOR PRESENT INTERRUPT

This application is a continuation of application Ser. No. 07/110,412, filed Oct. 20, 1987, now abandoned.

BACKGROUND OF THE INVENTION

1. Field of the Invention

The present invention relates to a copying apparatus with an interrupt function capable of automatically setting up copying conditions that are frequently used.

2. Description of the Prior Art

With recent rapid improvement in copying capabilities, copying apparatus have come to be provided with many and various functions such as continuous copying of a multi-page original, duplex copying, composite copying, binding margin provision, and anamorphic copying. As a result of such enhancement in capabilities and functions provided for copying apparatus, there arise problems that the setting up of copying conditions in the use of such copying apparatus becomes complicated and the handling thereof becomes difficult. For example, when using a copying apparatus, such various copying conditions as number of copies, copy density, magnification, and selected supply paper size, and further, whether the various functions are to be performed or not must be set up.

Regarding such problems, there have been proposed copying apparatus additionally provided with program keys for storing in memory some sets of copying conditions in a programmed fashion in advance such as that disclosed in U.S. Pat. No. 4,275,958. In this type of apparatus, the user is able to make programs for copying conditions in advance by using both the program keys and ten-keys and when the apparatus is to be operated the programmed copying conditions are called and set up by the user using those keys again. In this kind of apparatus, however, there are such disadvantages that the operations for programming those copying conditions and calling a program out of the stored programs are troublesome and that the control panel becomes more complicated because of the addition of the program keys, and as a result, operability of the copying apparatus is impaired rather than improved.

Many a copying apparatus is, for enabling it to interrupt its normal copying operation (a normal mode) halfway and copy another original (an interrupt copying mode), provided with an interrupt key for switching between the normal mode and the interrupt mode such as that disclosed in U.S. Pat. Nos. 4,543,643 and 4,0990,860. The interrupt key when it is pressed during the normal mode causes the copying conditions and status of copy production at that time to be temporarily stored in a memory, and some copying conditions, which were incorporated into the apparatus by the manufacturer of the copying apparatus, are set up as the initial setting and the mode is switched to the interrupt mode. And when the interrupt key is pressed again, the copying conditions and the status of copy production during the normal mode which have been temporarily stored are called back, and thereby, the apparatus is reset to the original state. However, when the mode is switched to the interrupt mode by means of the interrupt key, the same fixed copying conditions are invariably set up as the initial setting, and therefore, the user is then required to reestablish desired copying conditions. In actual use of the copying apparatus, it is rare that the interrupt copying is practiced, and it is rarer that the interrupt key is used for selecting the interrupt mode, and it is the real situation that the "interrupt key" is not effectively used.

Accordingly, an object of the present invention is to provide a copying apparatus having an interrupt function.

Another object of the present invention is to provide a copying apparatus with an interrupt function which will facilitate the troublesome setting up of copying conditions and simplify or eliminate the need for the operation for storing in a memory the copying conditions in advance and will thus provide improved operability.

SUMMARY OF THE INVENTION

The aforementioned objects are attained by a copying apparatus having an interrupt copying function comprising a first memory for storing therein copying conditions; an input device provided with a plurality of input keys for inputting copying conditions; a copying control for performing copying operations according to copying conditions stored in the first memory; a second memory for storing therein copying conditions in the preceding interrupt copying operation; a mode selection device for selecting the interrupt copying, mode capable of executing interrupt copying; and a system for establishing the copying conditions for the interrupt copying operation by transferring the copying conditions stored in the second memory to the first memory when the interrupt copying mode is selected by the mode selection device, thereby establishing the copying conditions identical to the preceding copying conditions.

The aforementioned objects are also attained by a copying apparatus having an interrupt copying function comprising a first memory for storing therein copying conditions; an input device provided with a plurality of input keys for inputting copying conditions; a copying control for performing copying operation according to copying conditions stored in the first memory; a mode switching arrangement for switching between normal copying mode and interrupt copying mode; a second memory for temporarily saving therein the copying conditions in the normal copying mode; a third memory for storing therein copying conditions in the preceding interrupt copying operation; a system for making, when the interrupt copying mode is selected by the mode switching arrangement initial setting of the copying conditions for the interrupt copying operation by saving the copying conditions stored in the first memory in the second memory and setting up the copying conditions stored in the third, memory in the first memory; and an arrangement for making, when the normal mode is selected by the mode switching means, set-up of the copying conditions existed before the interrupt copying operation by setting up the copying conditions stored in the second memory in the first memory.

DESCRIPTION OF THE PREFERRED EMBODIMENT

An embodiment of the present invention will be described below with reference to the accompanying drawings.

Figure 1:
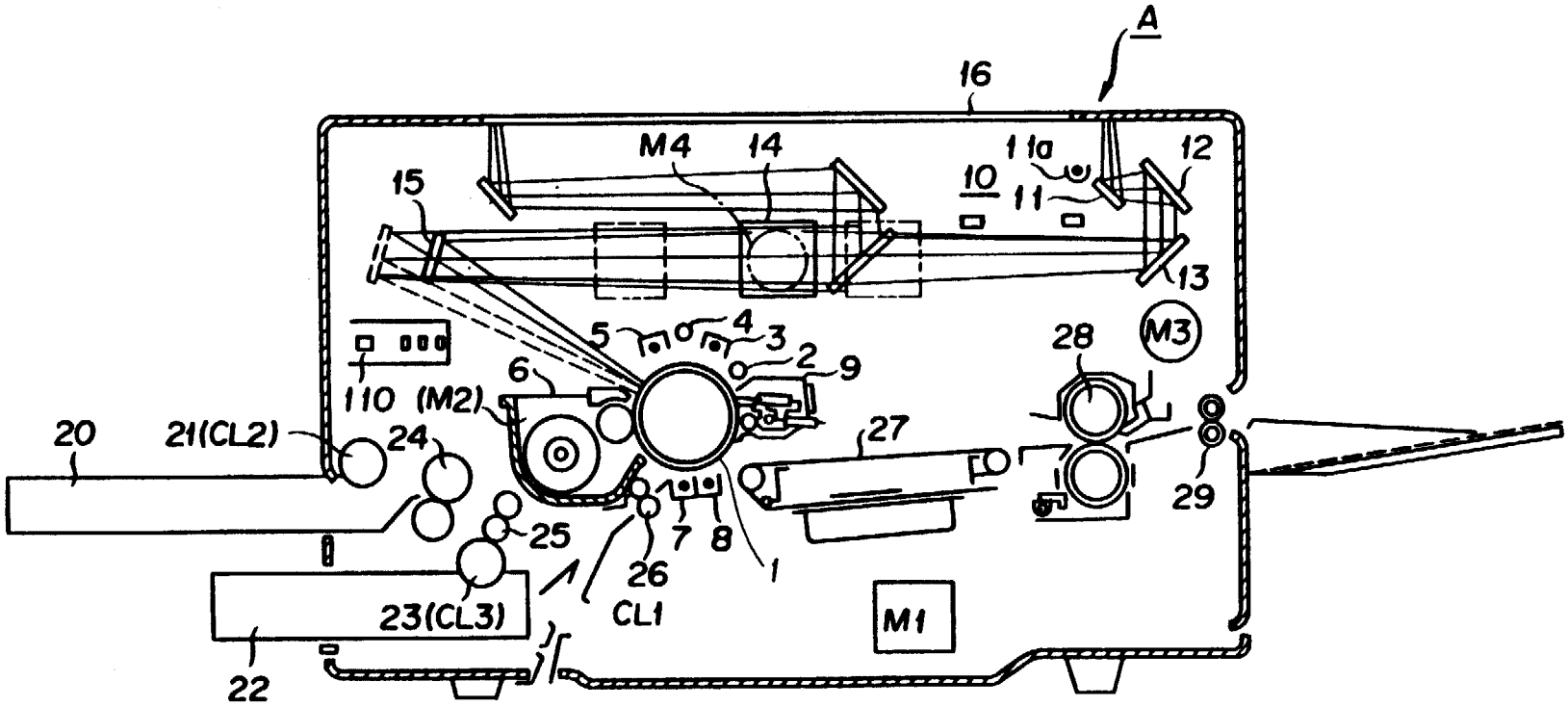
FIG. 1 is a front view in section schematically showing structure of a copying apparatus.

FIG. 1 is a front view in section schematically showing the structure of a copying apparatus A. Referring to the figure, virtually in the center of the body of the copying apparatus, there is provided a photosensitive drum 1 for rotation in a counterclockwise direction, and around the drum 1 are disposed a main eraser lamp 2, sub corona charger 3, sub eraser lamp 4, main corona charger 5, developing device 6, transfer charger 7, copy paper separation charger 8, and a blade type cleaning device 9. The photosensitive drum 1 is provided with a layer of a photosensitive material formed on its surface, and the photosensitive material is photosensitized and charged by passing through the eraser lamps 2 and 4 and the corona chargers 3 and 5 and subjected to an image exposure from an optical system 10.

The optical system 10 is disposed under a transparent original platen 16 so as to be able to scan an image of the original and the optical system 10 includes a light source 11*a*, movable mirrors 11, 12, and 13, a lens 14, and a mirror 15. Driven by a scan motor M3, the light source 11*a* and the movable mirror 11 are moved to the left at viewed in FIG. 1 at a speed of v/m, where m represents copy magnification, with respect to the circumferential speed v of the photosensitive drum 1, which is constant regardless of changes in the magnification, while the movable mirrors 12 and 13 are moved to the left at a speed of v/2m. When the magnification is changed, the lens 14 is moved along the optical axis followed by a shift and swing of the mirror 15, but explanation of the magnification changing device will not be given here because such is commonly known.

On the left-hand side of the body of the coping apparatus, there are disposed an upper paper supply portion 20 and a lower paper supply portion 22 including paper feeding rollers 21 and 23, respectively, while a transport path for the copy paper is formed by pairs of rollers 24 and 25, a pair of timing rollers 26, a transport belt 27, a fixing device 28, and a pair of discharge rollers 29.

Figure 2:
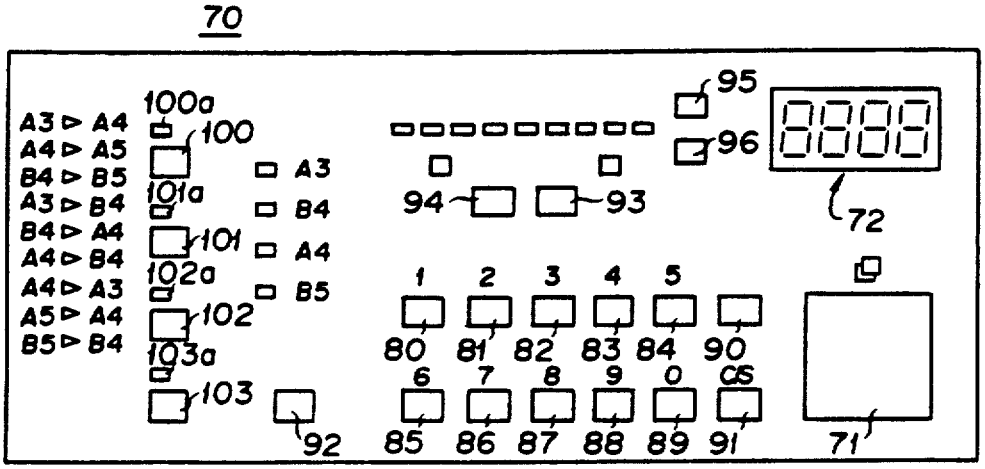
FIG. 2 is a plan view showing structure of an control panel of the copying apparatus.

FIG. 2 shows the arrangement of various operating keys on a control panel of the copying apparatus A. On the control panel 70, there are disposed a print key 71 for starting a printing operation, a numerical value display device 72 formed of a 7-segment LED capable of indicating numbers of four figures, ten-keys 80–89 corresponding to numerals 1, 2, 9, and 0, respectively, for setting up the number of copies, an interrupt key 90 for switching between the normal copying mode and the interrupt copying mode, a clear stop key 91 for stopping a copying operation and cancelling input made by other keys, a paper selection key 92 for selectively designating the paper feeding opening, either the upper paper feeding opening 20 or to the lower paper feeding opening 22, from which the copy paper is fed, UP and DOWN keys 93 and 94 for changing and setting up the copy image density stepwise, magnification setting keys 100–103 with their respective predetermined values of magnification assigned thereto, and LEDs 100*a*–103*a* provided in correspondence with the keys 100–103 for displaying the established copy magnification.

The interrupt copying mode is such that it will suspend a copying operation in the normal mode halfway and allow another copying operation to be performed. Upon pressing the interrupt key 90 in the middle of a copying operation in the normal mode, the copying operation is suspended, while the then existing copying conditions (number of copies, copy magnification, copy density, etc.) are temporarily stored in a memory, and the interrupt copying mode is established. Thereby, setting up of the copying conditions for the interrupt copying is enabled and the copying operation based on the thus established copying conditions is made possible to be performed. If the interrupt key 90 is pressed again in the course of the interrupt copying mode, the interrupt copying mode is cancelled and the copying conditions existent before the interruption and stored in the memory when the interrupt copying mode was established are automatically called back to be re-established, and thus, the mode is reset to the normal mode which was existent before application of the interruption. In the copying apparatus of the present invention, the copying conditions established in the interrupt copying mode are stored in the memory so that the next time the interrupt copying mode is established the copying conditions in the preceding interrupt copying mode are automatically called back and thereby the initial setting of the copying conditions for the interrupt copying are made.

Figure 3:
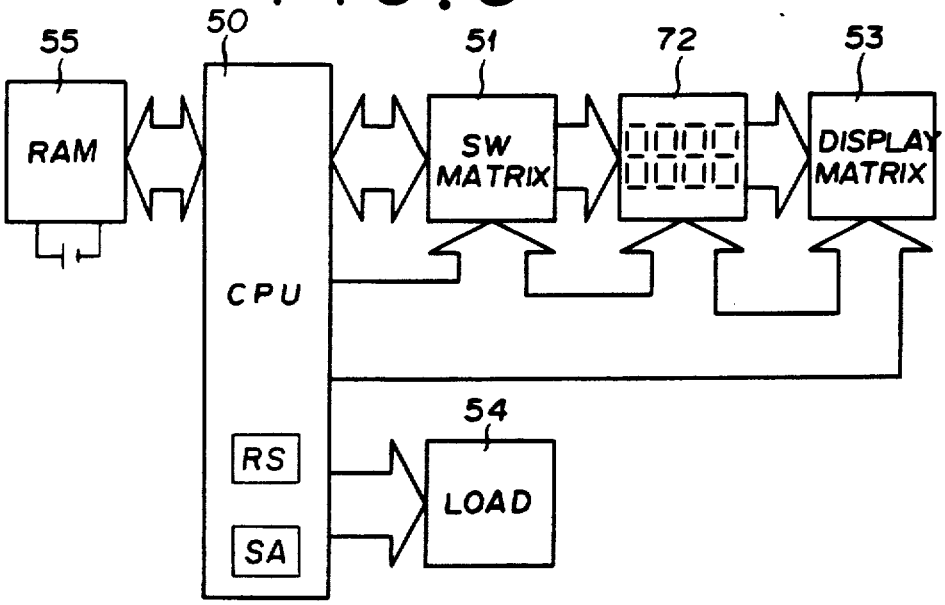
FIG. 3 is a block diagram schematically showing a control circuit in the copying apparatus.

FIG. 3 is a block diagram schematically showing a control circuit for the copying apparatus A. Referring to the figure, CPU denotes a microcomputer 50 which performs control of copying operations and control of the control panel portion. The microcomputer CPU outputs control signals to the keys 80–91 on the control panel 70, a switch matrix 51 composed of various detection switches for the interior of the body of the copying apparatus and the like, the-7-segment display 72, a display matrix 53 composed of LEDs 100*a*–103*a*, 106*a*, etc. on the control panel 70, and electrical load 54 such as the developing device 6, transfer charger 7, etc., and receives signals from the switch matrix 51. The microcomputer CPU includes a register RS which stores copying conditions input from keys on the control panel 70 and a stack area SA for saving therein, at the time when the interrupt mode is selected, the copying conditions before the interrupt copying. A read-write memory 55 backed up by a battery is for storing therein copying conditions as described later and adapted such that its contents are called when the interrupt mode is selected by operation of the interrupt key 90.

Now, steps in the process for copying operation performed in the microcomputer CPU will be described according to the flow charts in FIGS. 4–7.

Figure 4:
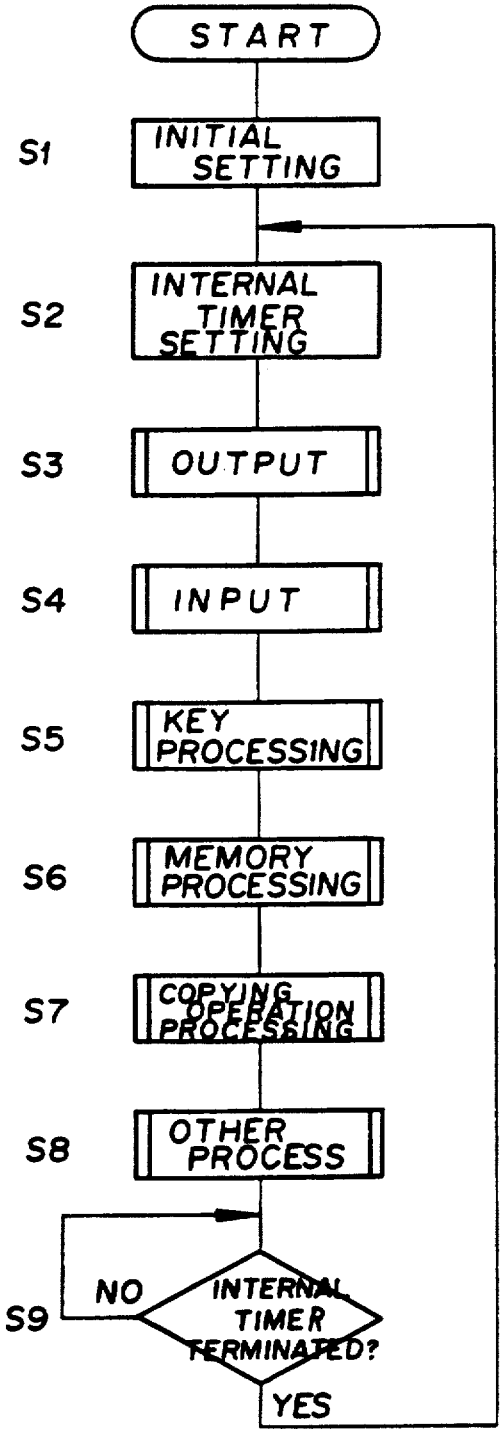
FIG. 4 is a flow chart showing steps of the procedure executed in the microcomputer CPU.

FIG. 4 schematically shows the overall structure of the process performed in the microcomputer CPU. After the program is started, at step S1, the microcomputer CPU is reset and then control variables for the microcomputer itself are present with predetermined data. At step S2, an internal timer for regulating the length of one routine is set. At step S3, signals are output to the display matrix 53 and the load 54, and at step S4, signals are received from the switch matrix 51. At step S5 a subroutine is executed for processing signals from each of the keys on the control panel 70, about which detailed description will be given later according to FIG. 5. At step S6, a process for renewing or updating the memory 55, and at steps S7 and S8, the process for copying operation according to the copying conditions stored in the register RS and other processes are executed. At step S9, the completion of the time period set by the internal timer is awaited, and upon the sequence returns to step S2. And thereby, completion of the routine is controlled to be constant.

Figure 5:
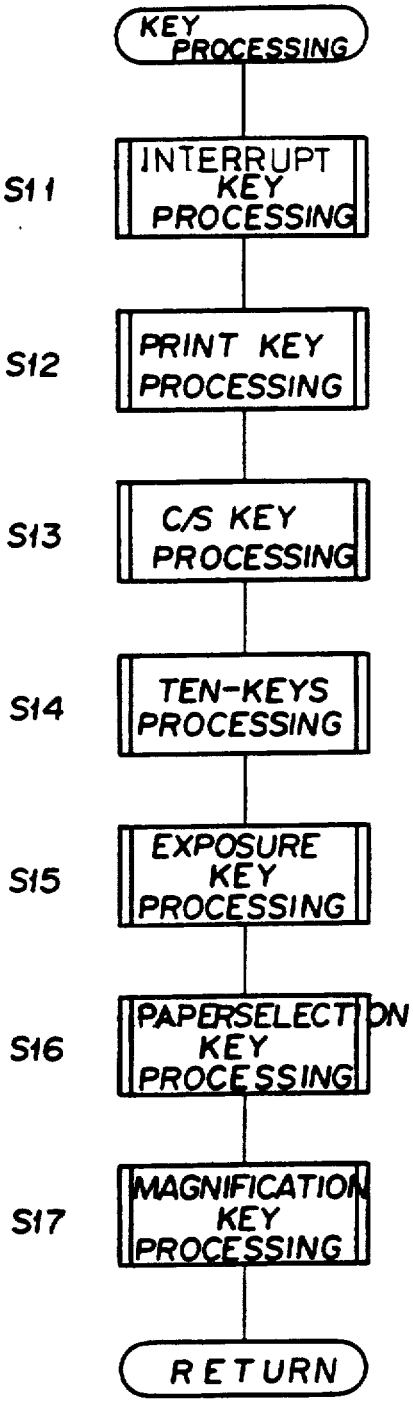
FIG. 5 is a flow chart showing steps of the procedure executed in the microcomputer CPU.

FIG. 5 is a flow chart showing the contents of the subroutine at the step S5 for processing the signals from the keys. At step S11, the subroutine for the process for the interrupt key is called, about which detailed description will be given later according to FIG. 6. Steps S12–S17 are the subroutines for processing signals from the other keys on the control panel 70, and in the subroutines of steps S14–S17, the copying conditions input from the control panel such as the number of copies, copy magnification, and copy density are stored in the register RS within the microcomputer.

Figure 6:
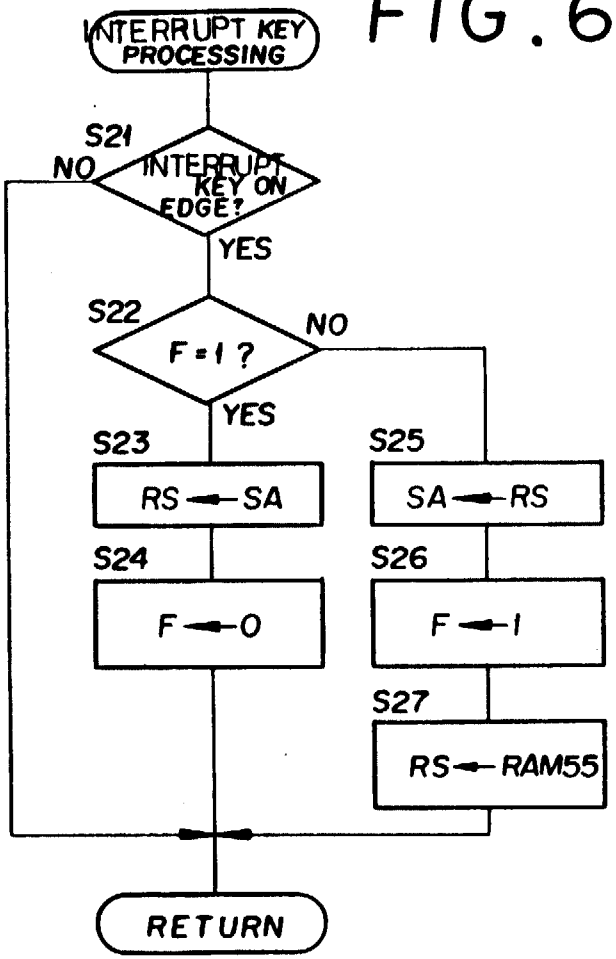
FIG. 6 is a flow chart showing steps of the procedure executed in the microcomputer CPU.

FIG. 6 is a flow chart showing the contents of the subroutine for the process for the interrupt key. At step S21, it is decided whether an ON edge from the interrupt key 90 has been detected or not, and if it has not been detected, the sequence is returned and this procedure is ended. When the ON edge has been detected, it is decided at step S22 whether the write flag F is "1" or not. This write flag F means a flag indicating the copying mode, i.e., when the write flag F is "1", it is indicated that the mode is the interrupt mode, and when the write flag F is not "1", it is indicated that the mode is the normal mode. When the write flag F is decided not to be "1" at step S22, i.e., in the case where the copying mode is the normal mode, the data representing the existing copying conditions (number of copies, copy magnification, copy density, etc.) stored in the register RS are temporarily saved in the stack area SA within the microcomputer CPU at step S25. Then, at step S26, the interrupt flag F is turned to "1" so that the copying mode indication is changed to the interrupt copying mode, and at step S27, the copying conditions stored in the memory 55 are read out and stored in the register RS whereby the initial setting of the copying conditions as those for the interrupt copying is executed. The copying conditions then stored in the memory 55 are the copying conditions at the time of the preceding interrupt copying, which are written therein at the step S32 in the later described processing subroutine for the memory. On the other hand, when the interrupt flag F is decided to be "1" at step S22, i.e., in the case where the then existing mode is the interrupt copying mode, the copying conditions in the normal mode before the interrupt copying stored in the stack area SA within the microcomputer CPU are read out and stored in the register RS at step S23, then at step S24, the interrupt flag F is turned to "0", and thus, the mode is restored to the normal copying mode. The copying conditions that are stored in the stack area SA are those in the normal mode that were written therein at the time of the aforesaid establishment of the interrupt copying at step S25.

According to the routine for the process for the interrupt key as described above, the normal mode and the interrupt mode are switched to each other by actuating the interrupt key 90, and when switched from the interrupt mode to the normal mode by the interrupt key 90, the copying conditions in the preceding normal mode before the interrupt mode are set up, while when switched to the interrupt mode, the copying conditions in the preceding interrupt mode are set up. The preceding copying conditions in the normal mode are stored in the stack area SA, while the copying conditions in the preceding interrupt mode are stored in the memory 55.

Figure 7:
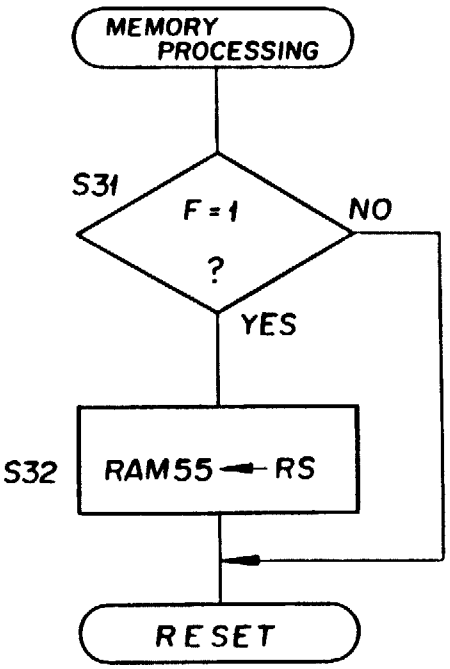
FIG. 7 is a flow chart showing steps of the procedure executed in the microcomputer CPU.

FIG. 7 is a flow chart showing the contents of the subroutine for the process for the memory at step S6. This subroutine is for storing in the memory 55 the copying conditions at the time when the interrupt mode is selected, i.e., whether the mode is the interrupt mode or not is decided according to the interrupt flag F at step S31, and if it is the interrupt mode, i.e., if the flag F is "1", then at step S32, the then existing copying conditions stored in the register RS are overwritten in the memory 55 so that the latest copying conditions in the interrupt mode may be stored therein. Since the memory 55 is backed up by a battery, the contents thereof are not destroyed even if the power supply is turned off, and when the interrupt mode is selected next time, the contents are called in the above described processing routine for the interrupt key and the copying conditions are used for the initial setting. After such initial setting has been made, the copying conditions can be freely altered by operations of the keys on the control panel 70, and when they are altered, the contents of the memory 55 are altered in the processing routine for the memory just described above.

According to the above described embodiment, when the interrupt mode is selected by the operation of the interrupt key 90, the latest copying conditions in the preceding interrupt mode are used for initial setting, and therefore, the copying apparatus can be immediately put in operation under the same copying conditions as in the preceding interrupt mode and there is no need for setting up the copying conditions again except when some alteration must be made, and thus, operability of the copying apparatus is improved. Besides, since the storing in the memory 55 of the copying conditions in the interrupt mode is automatically performed, it is not necessary to make operations for storing the copying conditions each time, and since the latest copying conditions in the interrupt mode are stored, it consequently leads to an automatic set-up of the frequently used copying conditions. In this sense also the operability is improved. Although it is adapted such that the stored copying conditions are called back and set up, the operation therefore is done by the hitherto used interrupt key 90 and no new key is required, so that, the cost can accordingly be kept down, and also, the control panel is prevented from becoming complicated. And when the mode is changed to the interrupt mode, the user can easily alter the copying conditions that are used for the initial setting. Thus, the interrupt copying is made easier to practice and the interrupt key 90 is enhanced in its usefulness.

Although, in the above described embodiment, the updating of the memory 55 is adapted to be performed at the same timing as the change of the copying conditions, the same can be performed, for example, at the timing when the interrupt mode is cancelled by the operation of the interrupt key 90, when the print key 71 is operated, or at other suitable timing. The processing routine for the interrupt key and that for the memory are suitably modified as to their contents or their positions in the flow charts. The interrupt key 90 may be named differently as long as it is a key having the above described function. Although the example was mentioned above in which a stack area within the microcomputer was used as the memory means for saving therein the copying conditions in the normal mode, it is not only way practicable. A portion of the RAM 55 may also be used as the stack area.

What is claimed is:

1. A copying apparatus having an interrupt copying function for performing an interrupt copying operation by interrupting a normal copying operation, comprising:

input means for manually inputting copying conditions;

first memory means for storing said copying conditions inputted by said input means;

copying control means for performing the normal copying operation and the interrupt copying operation according to the copying conditions stored in the first memory means;

mode switching means for switching between a normal copying mode in which the normal copying operation is performed by said copying control means and an interrupt copying mode in which the interrupt copying operation is performed by said copying control means;

second memory means for temporarily saving the copying conditions of the normal copying operation interrupted by the interrupt copying operation;

third memory means for storing the copying conditions, including manually inputted copying conditions, of an immediately preceding interrupt copying operation performed by the copying control means;

means for temporarily saving in said second memory means, when the normal copying mode is switched to the interrupt copying mode by said mode switching means, the copying conditions stored in said first memory means, and for initially setting up in the first memory mean the copying conditions of the immediately preceding interrupt copying operation which are stored in said third memory means; and means for saving in the third memory means, when the interrupt copying mode is switched to the normal copying mode by said mode switching means, the copying conditions, including manually inputted copying conditions, stored in said first memory means, and for setting up the copying conditions stored in said second memory means in said first memory means, whereby copying conditions in a preceding interrupt copying mode are initially set in the first memory means when the interrupt copying mode is selected by the mode switching means.

2. A copying apparatus according to claim 1, wherein said third memory means is a read-write memory.

3. A copying apparatus having an interrupt copying function comprising:

input means for manually inputting copying conditions;

mode selection means for selecting an interrupt copying mode in which an interrupt copying operation is effected;

memory means for storing copying conditions, including manually inputted copying conditions, under which a preceding interrupt copying operation was performed; and setting means for initially setting the copying conditions of the preceding interrupt copying operation which are stored in said memory means, including manually inputted copying conditions of the preceding interrupt copying operation, when the interrupt copying mode is selected by said mode selection means.

4. A copying apparatus according to claim 3, wherein said altering means includes input key means for manually inputting the copying conditions.

5. An interrupt copy control device of a copying apparatus for interrupting a normal copying operation and performing an interrupt copying operation and thereafter completing the normal copying operation, comprising;

inputting means for manually inputting copying conditions for said normal copying operation and for said interrupt copying operation;

memory means for receiving and storing said manually inputted copying conditions in which the normal copying operation and the interrupt copying operation are to be performed;

switching means for switching between a normal copying mode in which said normal copying operation is performed and an interrupt copying mode in which said interrupt copying operation is performed, said interrupt copying operation having a higher priority than said normal copying operation;

means for saving in said memory means the copying conditions, including manually inputted copying conditions, under which an immediately preceding interrupt copying operation was performed; and means for initially setting, when the normal copying operation is switched to the interrupt copying mode, the copying conditions stored in said memory means under which an immediately preceding interrupt copying operation was performed and for setting, when the interrupt copying mode is switched to the normal copying mode, the copying conditions that existed during the normal copying operation that was being performed before the switching means switched from the normal copying mode to the interrupt copying mode.

* * * * *

UNITED STATES PATENT AND TRADEMARK OFFICE

CERTIFICATE OF CORRECTION

PATENT NO. : 5,152,001

DATED : September 29, 1992

INVENTOR(S) : Hiroyuki HANAMOTO

It is certified that error appears in the above-identified patent and that said Letters Patent is hereby corrected as shown below:

In Column 8, line 20, delete "altering" and insert -- setting --.

Signed and Sealed this

Twenty-eighth Day of September, 1993

Bruce Lehman

*Attest:*

BRUCE LEHMAN

*Attesting Officer*

*Commissioner of Patents and Trademarks*